US007623772B2

(12) United States Patent
Stumphauzer et al.

(10) Patent No.: US 7,623,772 B2
(45) Date of Patent: Nov. 24, 2009

(54) MULTI-FUNCTION HEAT EXCHANGER

(75) Inventors: William C. Stumphauzer, Elyria, OH (US); Hugh F. Groth, Richfield, OH (US)

(73) Assignee: Liquamelt Corp., New York, NY (US)

( * ) Notice: Subject to any disclaimer, the term of this patent is extended or adjusted under 35 U.S.C. 154(b) by 81 days.

(21) Appl. No.: 11/693,805

(22) Filed: Mar. 30, 2007

(65) Prior Publication Data

US 2007/0166018 A1 Jul. 19, 2007

Related U.S. Application Data

(63) Continuation of application No. 11/290,380, filed on Nov. 30, 2005, now Pat. No. 7,221,859.

(60) Provisional application No. 60/632,158, filed on Dec. 1, 2004.

(51) Int. Cl.
*A47J 31/00* (2006.01)

(52) U.S. Cl. ..... 392/473; 392/465; 392/466

(58) Field of Classification Search ..... None
See application file for complete search history.

(56) References Cited

U.S. PATENT DOCUMENTS 4,006,845 A * 2/1977 Scholl et al. ..... 222/146.5
4,455,474 A * 6/1984 Jameson et al. ..... 392/472
4,505,406 A * 3/1985 Cobbs et al. ..... 222/135
4,669,661 A * 6/1987 Otto ..... 239/132.1
4,692,028 A * 9/1987 Schave ..... 366/22
5,076,469 A 12/1991 Pleuse et al.
5,478,014 A * 12/1995 Hynds ..... 239/135
6,034,168 A * 3/2000 Wang ..... 524/505
6,049,658 A * 4/2000 Schave et al. ..... 392/472
2004/0029980 A1 2/2004 Stumphauzer et al.
2005/0230423 A1 10/2005 Riney et al.

* cited by examiner

*Primary Examiner*—Thor S Campbell
(74) *Attorney, Agent, or Firm*—Rankin, Hill & Clark LLP

(57) ABSTRACT

A multi-function heat exchanger for use with a dispensing gun for dispensing hybrid plastisol hot melt material, the heat exchanger having an elongated tubular high temperature heater assembly having a front end hydraulically connected to an inlet port of a dispensing gun and a rear end connected to a heat dissipating assembly which in turn is connected to the outlet end of a supply hose for providing hybrid plastisol material which is liquid at room temperature and under sufficient hydraulic pressure to move the plastisol material through the heat dissipating assembly and the high temperature heater assembly into the dispensing gun when the gun is operated. The heater assembly has a heat source providing sufficient heat to turn the plastisol into a molten liquid as it passes into the dispensing gun. The heat dissipating assembly prevents heat from the high temperature heater assembly from migrating back into the plastisol supply hose.

10 Claims, 2 Drawing Sheets

FIG. 1
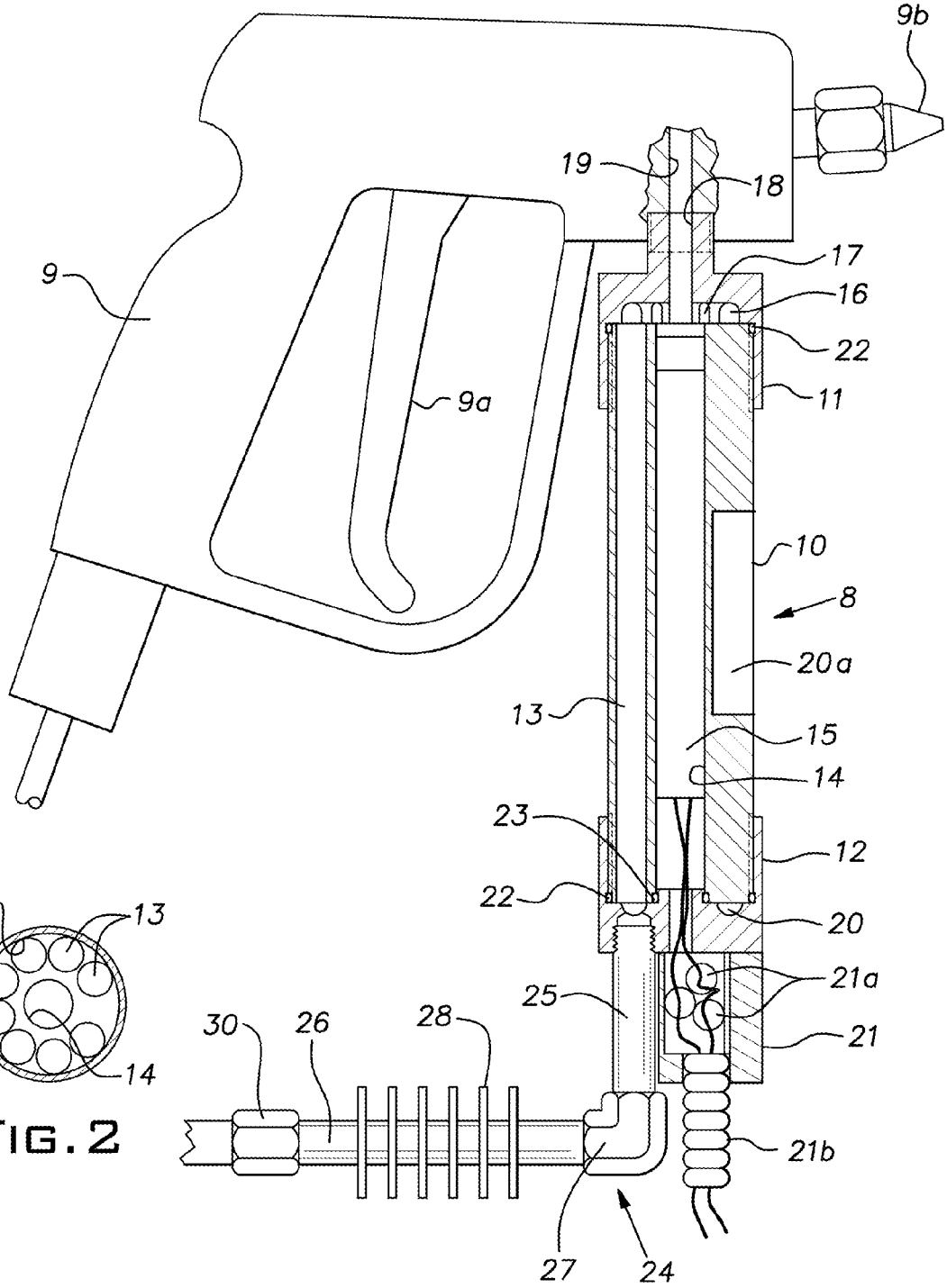
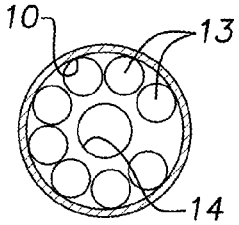
FIG. 2

MULTI-FUNCTION HEAT EXCHANGER

CROSS-REFERENCE TO RELATED APPLICATIONS

This application is a continuation of application Ser. No. 11/290,380, filed Nov. 30, 2005, now U.S. Pat. No. 7,221,859, and claims priority to provisional Application Ser. No. 60/632,158, filed Dec. 1, 2004.

BACKGROUND OF INVENTION

1. Field of Invention

This invention relates to a heating apparatus that will heat a hybrid plastisol hot melt that is a flowable liquid at room temperature to a temperature wherein the material becomes molten at approximately 280° F. to 350° F. In addition, the device statically mixes the molten liquid converting it to a hot melt as it exits from the apparatus into commercially available hot melt dispensing heads. Once the molten material is dispensed, it has adhesive properties identical to packaging hot melt.

2. Description of Related Art

U.S. Patent Application Publication No. 2004/0029980 A1 describes a hybrid plastisol hot melt composition that is liquid at room temperature. The hybrid plastisol is comprised of various micron-size resins and chemicals suspended in a liquid carrier. When this liquid is heated and mixed, it becomes a 100 percent solid hot melt that produces fiber-tear bonds when it is compressed and cooled between two cellulosic substrates.

This liquid hybrid plastisol exists in three distinct physical states. At room temperature, it is a liquid. When it is heated from 150° F. to approximately 270° F., it becomes a solid. When it is heated to approximately 280° F. and above, it becomes a molten liquid. When this molten liquid is mixed, it becomes a molten hot melt.

In order for this hybrid plastisol to be useful as a hot melt, it must be pumped under pressure through a device that heats the material to its molten temperature state and mixes its discrete molten ingredients to become a homogenous blend and be supplied under pressure to a manual or automatic dispenser. Unfortunately, before the hybrid plastisol reaches its melting point, it must pass through a temperature range between 150° F. and 270° F. during which it is a solid.

There are difficult challenges to overcome in order to elevate the temperature of this material from its liquid state at room temperature to its molten state at approximately 280° F. and above.

One specific problem to overcome is that between its room temperature liquid state and molten state at +300° F., the material is an un-pumpable solid. Therefore, an apparatus had to be developed that would minimize the volume of material existing in its solid state so that it could flow through supply hoses and piping via plug flow.

One method to achieve a minimal volume solid zone is to direct cooling compressed air at the supply piping feeding the heat exchanger. Heat migrating is mitigated by a 3 to 5 cfm air nozzle directed at the pipe nipple. The result is that the portion of material at its solid state is only 50 to 100 cc's within the pipe nipple, so it is easily forced into the heat exchanger by plug flow hydraulic pressure from the liquid contacting the solid plug.

One major disadvantage to the above is the requirement for compressed air which is a very expensive utility that would have to be supplied to multiple heat exchangers in a manufacturing environment. A further disadvantage is if plant air availability is interrupted for any reason heat will migrate from the ⅛ inch supply nipple into the supply hose causing material to solidify in the pipe and hose in sufficient volume that it cannot be moved by hydraulic pressure; therefore, material supply is stopped.

The present invention is a combination heat exchanger heat dissipater that minimizes the volume of material held at its solid phase temperature range of 150° F. to 270° F. The heat dissipater is static and does not require the use of compressed air.

The heat exchanger combination performs three functions simultaneously, heat the incoming material to its melting temperature, statically mix the molten material as it exits from the heat exchanger and statically dissipate thermal energy so that it does not migrate into the room temperature supply hose; thus minimizing the volume of material held at its solid phase temperature range of 150° F. to 270° F.

OBJECTS OF THE INVENTION

One of the objects of the invention is to provide a means to heat a room temperature liquid hybrid plastisol to its molten temperature of 270° F. and above and simultaneously mix the molten material so that it becomes a homogeneous hot melt before it exits the heating device.

Another objective of this invention is to provide a means to minimize the volume of the hybrid plastisol held resident in the heater at the temperature at which the material is a solid so that it could still be pumped by plug flow.

Another objective of this invention is to prevent thermal energy from migrating from the heating device into the supply hose so that the liquid resident in the supply hose will not be heated to its solidification temperature.

BRIEF SUMMARY OF THE INVENTION

This invention is a heat exchanger that simultaneously performs the following functions:

1. Heats incoming room temperature liquid hybrid plastisol to its melting temperature on a first-in first-out flow path.
2. Statically mixes the molten material so that it is transformed into a hot melt as it exit's the heat exchanger.
3. Minimizes the volume of material held at a temperature at which it is a non-flowable solid.
4. Prevents thermal energy from migrating from the heat exchanger to the supply hose and piping so that the material held in residence therein does not reach its solidification temperature.

BRIEF DESCRIPTION OF THE DRAWINGS

FIG. 1 is a side elevational assembly drawing of the invention with part of the heat exchanger broken away to show a vertical cross section through the heat exchanger body and end caps and including a side view of the thermal dissipater and an outline drawing of a commercially available manual dispensing gun for hot melt;

FIG. 2 is an end view of the heat exchanger body;

DETAILED DESCRIPTION OF THE INVENTION

Figure 3:
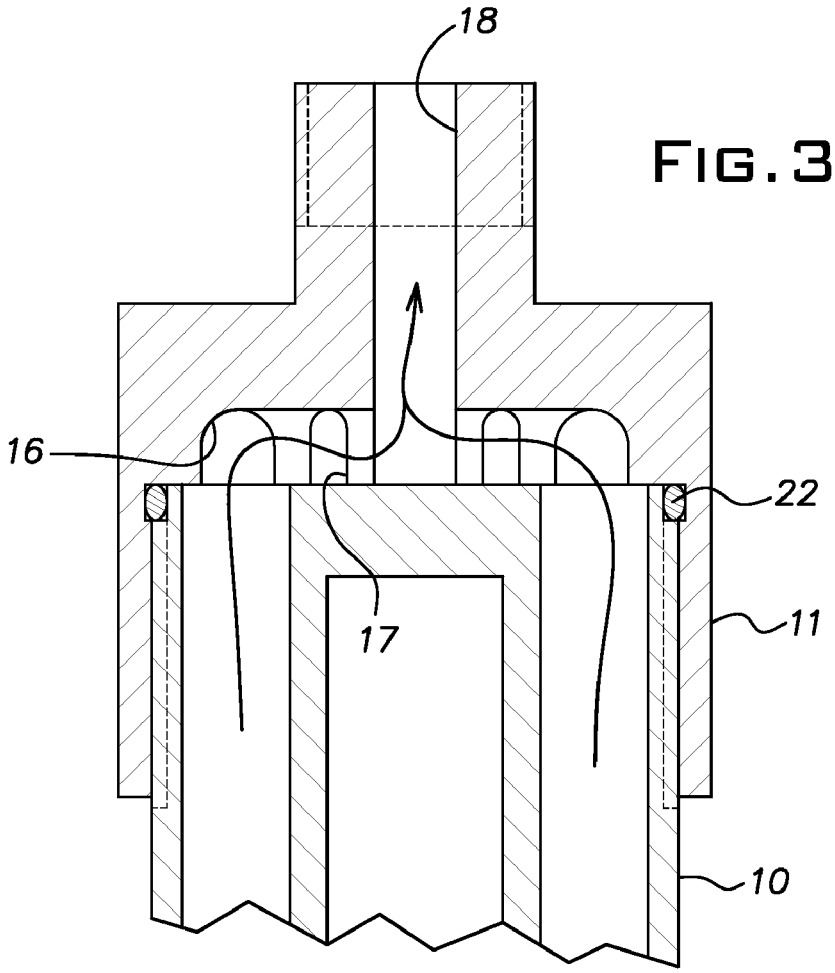
FIG. 3 is a sectional side view of the brass end cap attached to the upper end of a fragmentary portion of the heat exchanger body.

Referring now to the drawings and in particular to FIG. 1, the entire heat exchanger assembly is indicated by the numeral 8 which is attached to a commercially available manual dispensing gun 9 for dispensing hot melt material. The gun 9 has a trigger 9*a* and a dispensing nozzle 9*b*. Since the gun is a commercially available gun a further description of its interior working parts should not be necessary.

The heat exchanger assembly 8 has an elongated tubular aluminum body 10 which has a front end cap 11 and a rear end cap 12. As shown in FIGS. 1 and 2, the body 10 has eight symmetrically space fluid ports 13 and a centrally located hole 14 extending longitudinally through the body 10 and retaining therein a heating cartridge 15. The front end cap 11 is made from a thermally conductive metal such as copper or aluminum so as to conduct heat into the heated dispensing gun 9.

The front end cap 11 has eight, 90° mixing channels 16 and 17 that statically mix the molten material as it exits the heat exchanger through an axial port 18 in communication with an intake port 19 in the dispensing gun 9.

The heating cartridge 15 heats the entire body 10 and end caps 11 and 12. The end cap 12 is made of a poor thermally conductive metal such as stainless steel to reduce the rearward transfer of heat from the heat exchanger assembly 8.

Figure 4:
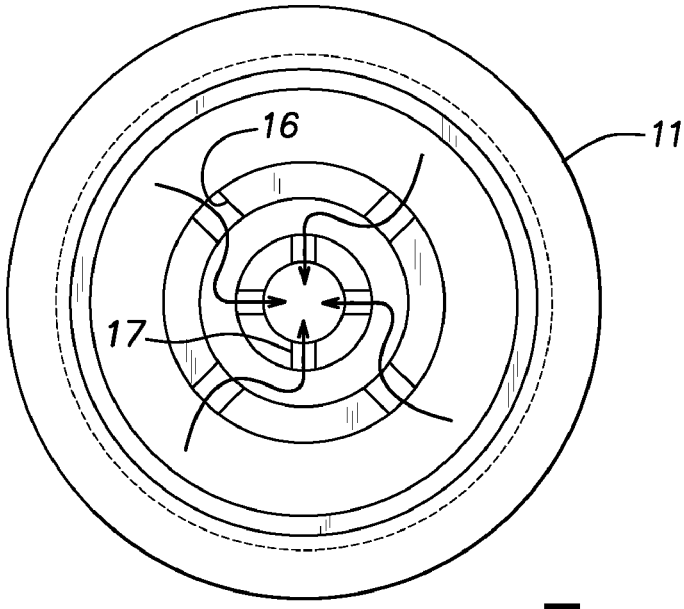
FIG. 4 is an end view of the upper mixer end cap looking into the end that fits on the upper end of the heat exchanger body as show in FIGS. 1 and 3.

An annular fluid channel 20 in end cap 12 feeds fluid to the eight fluid ports 13. A channel groove 20*a* is milled into the body 10 so that a temperature sensor (not shown) may be located therein as close to the heating cartridge 15 as possible. Wire retainer 21 is mechanically attached to the body 10 providing a cavity for twist-on wire connectors 21*a* and mechanical clamping of armored cord set 21*b*. "O" rings 22 and 23 hydraulically seal the end caps 11 and 12 to the body 10. In both FIGS. 3 and 4, the arrows indicate the fluid flow as it passes through mixing channels 16 and 17 and exits the end cap 11 through the exit port 18 to pass into the dispensing gun 9.

A heat dissipating assembly 24 has one-eighth inch stainless steel pipe nipples 25 and 26 connected together by an elbow 27. The nipple 25 is connected to the rear end cap 12 of the +300° F. heat exchanger 8 and the nipple 26 is connected to a supply hose 30 which provides hybrid plastisol which is liquid at room temperature.

Six aluminum heat dissipating discs 28 are press-fit onto stainless steel pipe nipple 26. The diameter of thickness and spacing and quantity of discs can vary considerably, but in the present example; there are six aluminum discs 1.25 inches in diameter and 0.064 inches thick press-fit onto a one-eighth inch stainless steel pipe nipple 26. Spacing between discs 28 is 0.300 inches. The temperature differential between elbow 27 and the front end cap 11 is a minimum of 200° F.

The heat dissipating assembly 24 prevents the +300° F. heat from the heat exchanger 8 from migrating rearwardly into the supply hose 30 where the hybrid plastisol is at room temperature.

In operation, when the trigger 9*a* is squeezed, a valve (not shown) in the gun 9 is opened to permit molten hybrid plastisol to flow from the outlet port 18 of the heart exchanger 8 and into the inlet port 19 of the gun 9 where it passes through the dispensing nozzle 9*b* where it is deposited onto a surface to receive the hot melt adhesive. The pressure in the supply hose forces the hybrid plasisol through the heat dissipating assembly 24, the heat exchanger assembly 8 and the dispensing gun 9.

Variations can be made in the arrangement of the parts in the heat exchanger assembly and the heat dissipating assembly without departing from the scope of the invention so long as the apparatus maintains the temperature differentials mentioned herein between the plastisol material when in the supply hose and when it is in the heat exchanger assembly. For example it should be recognized that the heat dissipating assembly could be made from a single piece of pipe which is straight or curved with the heat dissipating disks or fins mounted thereon.

What is claimed is:

1. A method of dispensing a hot melt adhesive material that can be heated from a lower temperature flowable non-molten liquid state to a higher temperature molten liquid state, the method comprising:

pumping the hot melt adhesive material in the lower temperature flowable non-molten liquid state through a supply conduit to a heat exchanger assembly comprising a heating element;

heating the hot melt adhesive material in the heat exchanger assembly to the higher temperature molten liquid state using the heating element;

dissipating heat from the heating element in the heat exchanger assembly, without directing cooling compressed air at the supply conduit, to prevent heating the hot melt adhesive material in the supply conduit above the lower temperature flowable non-molten liquid state; and dispensing the hot melt adhesive material in the higher temperature molten liquid state from a dispensing gun in fluid communication with the heat exchanger assembly.

2. The method according to claim 1 further comprising mixing the hot melt adhesive material in heat exchanger assembly in the higher temperature molten liquid state using a static mixing element to form a homogeneous blend.

3. The method according to claim 1 further comprising:

disposing the hot melt adhesive dispensed from the dispensing gun in the higher temperature molten liquid state between a first cellulosic packaging substrate and a second cellulosic packaging substrate; and compressing the first cellulosic packaging substrate and the second cellulosic packaging substrate together with the hot melt adhesive material disposed therebetween until the hot melt adhesive material cools and thereby bonds the first cellulosic packaging substrate and the second cellulosic packaging substrate together.

4. The method according to claim 3 wherein the bond between the first cellulosic substrate and the second cellulosic substrate is a fiber-tear bond.

5. A method of dispensing a hot melt adhesive material that can be heated from a lower temperature flowable non-molten liquid state to a higher temperature molten liquid state, the method comprising:

pumping the hot melt adhesive material in the lower temperature flowable non-molten liquid state through a supply conduit to a heat exchanger assembly comprising a heating element, wherein the hot melt adhesive material flows from the supply conduit through a heat dissipating assembly to the heat exchanger assembly, and wherein the heat dissipating assembly prevents heat from the heating element in the heat exchanger assembly from heating the hot melt adhesive material in the supply conduit above the lower temperature flowable non-molten liquid state;

heating the hot melt adhesive material in the heat exchanger assembly to the higher temperature molten liquid state using the heating element; and dispensing the hot melt adhesive material in the higher temperature molten liquid state from a dispensing gun in fluid communication with the heat exchanger assembly.

6. The method according to claim 5 further comprising mixing the hot melt adhesive material in heat exchanger assembly in the higher temperature molten liquid state using a static mixing element to form a homogeneous blend.

7. The method according to claim 5 further comprising:

disposing the hot melt adhesive dispensed from the dispensing gun in the higher temperature molten liquid state between a first cellulosic packaging substrate and a second cellulosic packaging substrate; and compressing the first cellulosic packaging substrate and the second cellulosic packaging substrate together with the hot melt adhesive material disposed therebetween until the hot melt adhesive material cools and thereby bonds the first cellulosic packaging substrate and the second cellulosic packaging substrate together.

8. The method according to claim 7 wherein the bond between the first cellulosic substrate and the second cellulosic substrate is a fiber-tear bond.

9. A method for producing packaging, the method comprising:

providing a hot melt adhesive material that can be heated from a lower temperature flowable non-molten liquid state to a higher temperature molten liquid state;

pumping the hot melt adhesive material in the lower temperature flowable non-molten liquid state through a supply conduit to a heat exchanger assembly comprising a heating element, wherein the hot melt adhesive material flows from the supply conduit through a heat dissipating assembly to the heat exchanger assembly, and wherein the heat dissipating assembly prevents heat from the heating element in the heat exchanger assembly from heating the hot melt adhesive material in the supply conduit above the lower temperature flowable non-molten liquid state;

heating the hot melt adhesive material in the heat exchanger assembly to the higher temperature molten liquid state using the heating element;

dispensing the hot melt adhesive material in the higher temperature molten liquid state from a dispensing gun in fluid communication with the heat exchanger assembly;

disposing the hot melt adhesive dispensed from the dispensing gun in the higher temperature molten liquid state between a first cellulosic substrate and a second cellulosic substrate; and compressing the first cellulosic substrate and the second cellulosic substrate together with the hot melt adhesive material disposed therebetween until the hot melt adhesive material cools and thereby bonds the first cellulosic substrate and the second cellulosic substrate together.

10. The method according to claim 9 wherein the bond between the first cellulosic substrate and the second cellulosic substrate is a fiber-tear bond.

* * * * *